US005335898A

United States Patent [19]

Johnson

[11] Patent Number: 5,335,898

[45] Date of Patent: Aug. 9, 1994

[54] APPARATUS AND METHOD FOR CLAMPING STRUCTURAL MEMBERS DURING JOINDER

[75] Inventor: Charles E. Johnson, Charlotte, N.C.

[73] Assignee: Kajur Kulp, Charlotte, N.C. ; a part interest

[21] Appl. No.: 20,655

[22] Filed: Feb. 22, 1993

[51] Int. Cl.[5] ..... B25B 5/14

[52] U.S. Cl. ..... 269/41; 269/219; 269/283; 269/282

[58] Field of Search ..... 269/41, 53, 54–54.3, 269/244, 265, 271, 279, 280, 283, 219; 81/6; 29/275

[56] References Cited

U.S. PATENT DOCUMENTS

| | | | |
|---|---|---|---|
| 2,186,198 | 1/1940 | Krumbach . | |
| 4,021,516 | 5/1977 | Stevenson . | |
| 4,162,785 | 7/1979 | Johnson | 269/41 |
| 4,236,703 | 12/1980 | Stevenson . | |
| 4,475,726 | 10/1984 | Smith . | |
| 5,135,206 | 8/1992 | Martinez . | |
| 5,218,749 | 6/1993 | Upthegrove | 29/275 |

FOREIGN PATENT DOCUMENTS

| | | | |
|---|---|---|---|
| 2900109 | 7/1980 | Fed. Rep. of Germany | 269/41 |

*Primary Examiner*—Robert C. Watson

*Attorney, Agent, or Firm*—Shefte, Pinckney & Sawyer

[57] ABSTRACT

An apparatus is disclosed for woodworking and like applications to clamp structural members in abutting relation by initial formation of a pair of recesses in the structural members on a common imaginary line perpendicular to the intended joint line. The clamping apparatus has two clamping members each having an outwardly projecting engagement portion configured to fit securely in the recesses and a clamping mechanism actuable to move the clamping members and their engagement portions toward and away from one another for clamping movement along a clamping line coinciding with the imaginary line perpendicular to the intended joint line. The clamping apparatus may be used in forming virtually any edgewise abutting joint between respective structural members, e.g., miter joints, butt joints, linear edge joints, and radius edge joints.

8 Claims, 3 Drawing Sheets

APPARATUS AND METHOD FOR CLAMPING STRUCTURAL MEMBERS DURING JOINDER

BACKGROUND OF THE INVENTION

The present invention relates generally to clamping apparatus and methods and, more particularly, to such apparatus and methods by which a pair of structural members are clamped in abutting relation during joinder thereof, especially in woodworking applications.

In the manufacture of furniture, cabinetry, and numerous other woodworking operations, it is commonly necessary or desirable, either for structural or aesthetic reasons, to join two structural pieces of wood with their side or end edges in abutting relation. For example, the end edges of two elongate pieces of wood may be cut at corresponding angles to facilitate end-abutted joinder of the structural wood members in angular relation to one another, commonly referred to as a miter joint. Similarly, two elongate pieces of wood may be cut squarely at their ends for end-abutted joinder of the wood members in longitudinal alignment with one another, forming a so-called butt joint. Elongate pieces of wood may also be joined with their longitudinal edges abutted together, commonly referred to as an edge joint when the abutted edges are linear and a radius joint when the abutted edges are curved.

Regardless of the type of woodworking joint involved, it is a widely recognized problem within the woodworking industry to securely clamp the adjoining structural wood members in the abutted relationship desired during the joining operation to ensure that the respective edges are held in continuous abutment along the entire length of the joint line while a joint adhesive sets or a mechanical fastener is installed to secure the joint. While numerous types of woodworking clamps exist on the market, such clamps typically have specialized applications and therefore are not universally suitable for use in clamping various types of joints. Moreover, although a number of specialty clamps exist intended especially for clamping miter joints, none of these clamps are known to function satisfactorily for this purpose.

SUMMARY OF THE INVENTION

Accordingly, it is an object of the present invention to provide a novel apparatus and method which functions reliably for clamping structural members, particularly in woodworking applications, during joinder thereof in edge-abutting relation. It is a further object of the present invention to provide such a clamping apparatus and method which is suitable for use with a variety of differing joints ranging from, but not limited to, miter joints, butt joints, and differing forms of edge joints, with substantially equally satisfactory results.

Fundamentally, the clamping apparatus and method of the present invention contemplates initially forming the structural members to be joined with respective symmetrical recesses located on a common line substantially normal, i.e. perpendicular, to the joint line to be formed between respective edges of the structural members when abutted.

According to the invention, the present apparatus comprises first and second clamping members each having an engagement portion projecting outwardly therefrom, with each engagement portion being of a symmetrical cross-sectional configuration compatible with a respective one of the recesses in the structural members to fit securely therein. A selectively actuable clamping arrangement is connected to each clamping member for moving their engagement portions toward and away from one another, thereby for drawing the respective edges of the structural members into abutting relation when the engagement portions are received in the recesses.

In accordance with the method of the present invention, after the recesses are initially formed in the structural members, the structural members are arranged with their respective edges in adjacent facing parallel relation to one another and the engagement portions of the clamping members are engaged respectively within the recesses, after which the clamping arrangement of the clamping apparatus is actuated to move the clamping members toward one another along a clamping line substantially normal to the edges of the structural members to draw them into abutting relation to form the joint line therebetween.

Preferably, each engagement portion of each clamping member and each recess in each structural member is formed of the configuration of an elongate solid geometric body having a constant cross-section of a regular plane geometric shape concentric about a common longitudinal axis. For example, engagement portions and recesses of a cylindrical configuration are preferred since cylindrical recesses may be easily drilled into the structural members using readily available conventional tools.

The engagement portions may be selectively removable from the clamping members for easy replacement. For example, a set of interchangeable engagement portions of differing sizes may be provided for each clamping member to enable selective attachment thereto of any selected one of the engagement portions.

Preferably, each of the clamping members is elongate and generally linear in configuration, and each engagement portion extends from the respective clamping member in substantial alignment to its elongate linear extent. The clamping arrangement connects the clamping members in adjacent side-by-side facing relation and is operative to move the clamping members in a translatory manner toward and away from each other. In the preferred embodiment, the clamping arrangement utilizes a pair of clamping arms connected to the clamping members at spaced locations for selective adjustability of the clamping force exerted on the engagement portions.

DESCRIPTION OF THE PREFERRED EMBODIMENT

Figure 1:
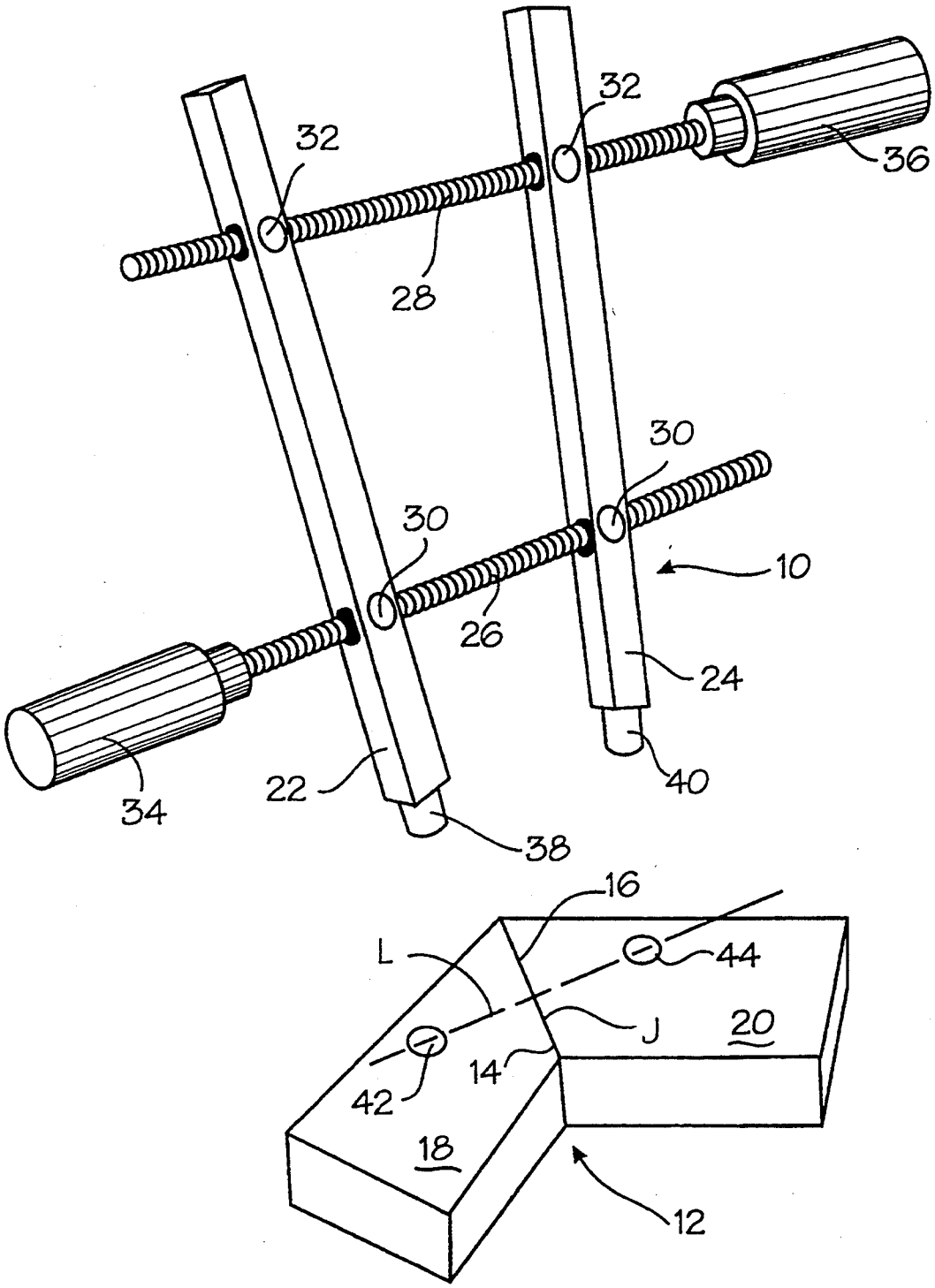
FIG. 1 is a perspective view of one preferred embodiment of the clamping apparatus of the present invention, shown in operation clamping two structural members in a miter joint.

Referring now to the accompanying drawings and initially to FIG. 1, a clamping apparatus according to the preferred embodiment of the present invention is broadly indicated at 10 in operation clamping a miter joint 12 formed between angularly-cut ends 14, 16 of a pair of elongate structural members 18, 20, e.g., conventional wood boards or planks. Of course, as those persons skilled in the art will readily recognize and understand, the clamping apparatus and method of the present invention is not limited to use in clamping miter joints nor is the present invention restricted to clamping structural members of wood or other woodworking applications but, rather, the invention is equally applicable to forming butt, edge and other joints between various types of structural members in diverse applications other than woodworking.

The clamping apparatus 10 basically includes a pair of elongate substantially linear clamping members 22, 24 connected in side-by-side facing relation for translatory movement toward and away from one another by a pair of threaded actuating rods 26, 28 extending in spaced relation transversely between the clamping members 22, 24 in threaded engagement through upper and lower swivel bearings 30, 32 rotationally supported by the clamping members 22, 24. Each actuating rod 26, 28 has a respective handle 34, 36 located at opposite ends of the rods 26, 28 whereby opposing rotational operation of the actuating rods 26, 28 acts through the threaded swivel bearings 30, 32 to selectively move the clamping members 22, 24 toward or away from one another depending upon the direction of rotational operation of the rods 26, 28.

As thus far described, the clamping apparatus 10 is essentially of the same conventional construction and operation as common woodworking and machinist's clamps. However, according to the present invention, and in contrast to conventional clamps, the clamping members 22, 24 of the present clamping apparatus 10 do not function themselves to clampingly engage structural members. Rather, each clamping member 22, 24 is equipped at one end thereof with an outwardly projecting engagement portion 38, 40 which are adapted to clampingly engage in compatible recesses formed in the structural members to be clamped, as more fully explained below. According to the present invention, each engagement portion 38, 40 is of a symmetrical geometric configuration in the form of an elongate solid geometric body having a constant cross-section of a regular plane geometric shape (e.g. circular or a regular polygon) concentric about a common longitudinal axis. A cylindrical configuration is preferred for the engagement portions 38, 40 for ease and simplicity of fabrication and because formation of compatible cylindrical recesses in structural members to be clamped is most readily accomplished by drilling operations using conventional readily available tools.

The use and operation of the clamping apparatus 10 in accordance with the method of the present invention may thus be understood. Initially, the end or side edges of the structural members to be joined are cut at compatible angles or curvatures to facilitate the desired edgewise abutment, e.g., the angled edges 14, 16 of the structural members 18, 20, as is conventional. The structural member edges may otherwise also be formed with a tongue and groove or other mating elements depending on the nature of the joint and the intended manner of joinder. Then, in accordance with the present invention and as depicted in FIG. 1, at least one pair of recesses 42, 44 are formed respectively in the structural members 18, 20 along a common imaginary line L extending substantially normal, i.e., perpendicular, to the intended joint line J between the structural member edges 14, 16.

The number of pairs of recesses 42, 44 will depend on the length and configuration of the joint to be formed. As shown in FIG. 1, a miter joint such as the joint 12 wherein the joint line J is of a relatively short dimension, i.e., only a matter of a few inches, should require only one pair of recesses, whereas in contrast linear or radius edge joints which extend several feet in length will require several pairs of recesses at spacings along the length of the joint.

In any case, the recesses 42, 44 should be of a geometric configuration and dimension the same as or compatible with that of the engagement portions 38, 40 of the clamping members 22, 24. Specifically, as with the engagement portions 38, 40, the recesses 42, 44 preferably are of a cylindrical configuration which may be readily formed by drilling, but alternatively may be of any other geometric configuration having a constant cross-section of a regular plane geometric shape concentric about a common longitudinal axis. Moreover, as those persons skilled in the art will understand, so long as the engagement portions 38, 40 and the recesses 42, 44 are of substantially corresponding maximum cross-sectional dimensions taken radially from the respective axes thereof, the engagement portions 38, 40 and the recesses 42, 44 need not necessarily be of the same geometric shape. For example, the engagement portions 38, 40 could be machined to be of a square or hexagonal cross-section while the recesses 42, 44 are formed of a cylindrical shape and dimension in which the engagement portions 38, 40 will fit securely.

With the edges 14, 16 of the structural members 18, 20 and the recesses 42, 44 therein thusly prepared, the structural member edges 14, 16 are initially fitted together or otherwise arranged in closely adjacent facing parallel relation to one another preparatory to joinder. If securement of the joint is to be accomplished by an adhesive, each edge 14, 16 is initially coated with the desired adhesive. The engagement portions 38, 40 of the clamping members 22, 24 are then inserted into the respective recesses 42, 44, whereupon the handles 34, 36 are operated to rotate the threaded actuating rods 26, 28 to draw the clamping members 22, 24 toward one another, thereby correspondingly drawing the engagement portions 38, 40 along the clamping line L substantially perpendicular to the edges 14, 16 of the structural members 18, 20 to draw them into abutting relation along a continuous joint line J therebetween.

Advantageously, the clamping apparatus of the present invention provides a reliable means of applying a controllable clamping force directly in line perpendicularly to the joint to be produced, regardless of the nature or configuration of the joint. Thus, a single clamping apparatus in accordance with the present invention is uniquely usable in the formation of a variety of differing joint configurations and can thereby serve the function of a number of different specialty clamps in conventional use. Moreover, since the recesses 42, 44 can be formed on the side of the structural members 18, 20 which will not be visible in use, the recesses do not affect the aesthetics of the structural members and, indeed, the formation of such recesses in application of the present invention are highly preferable to conventional clamps which must be placed in engagement with surfaces of the structural members which will be visible in the ultimate use of the structural members. Finally, one of the greatest advantages of the present apparatus and method is the convenient and reliable facilitation of clamping miter joints for which no known conventional clamping device functions satisfactorily.

Figure 2:
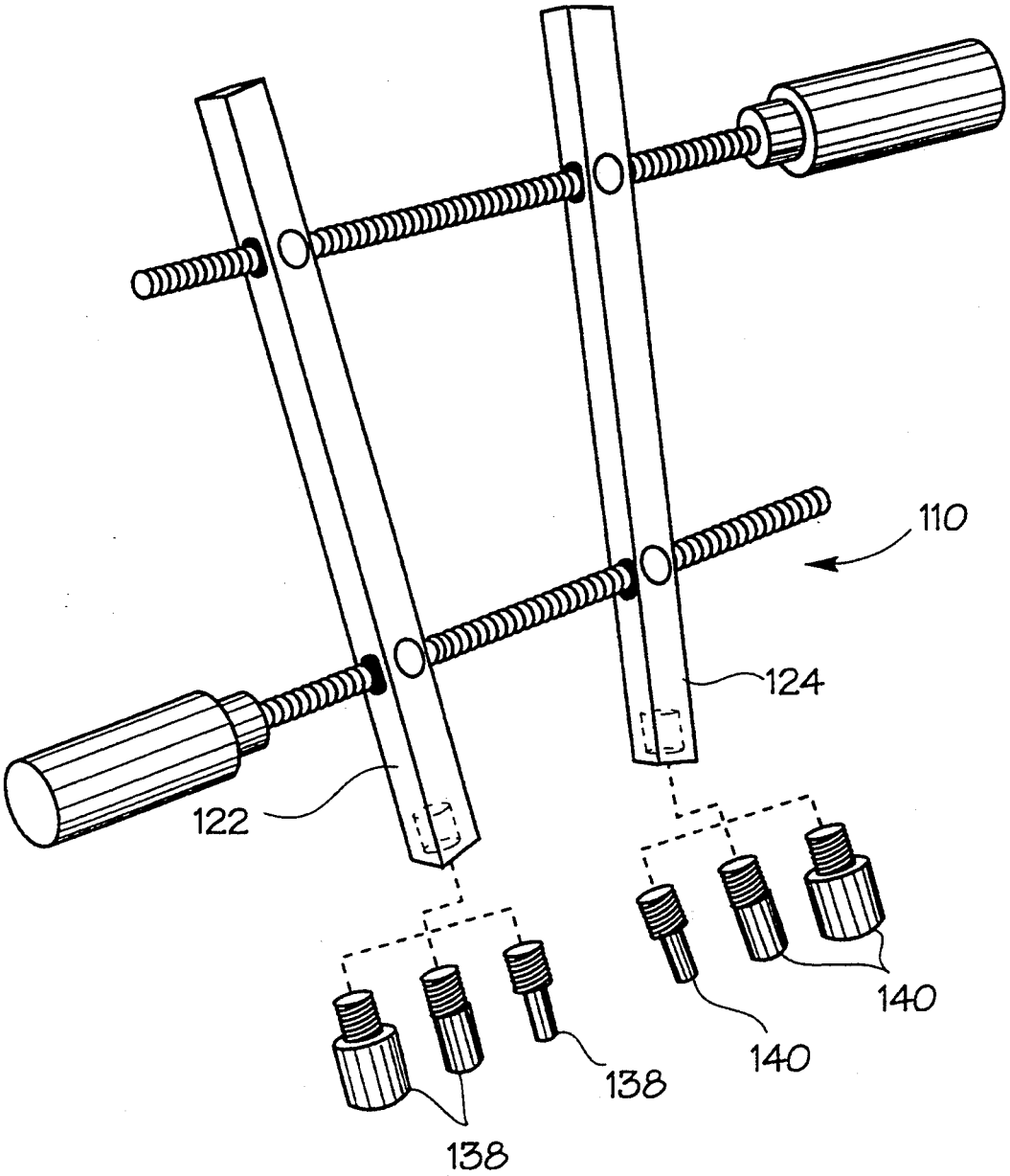
FIG. 2 is a perspective view of another preferred embodiment of the clamping apparatus of the present invention, equipped with removable interchangeable engagement portions.
Figure 3:
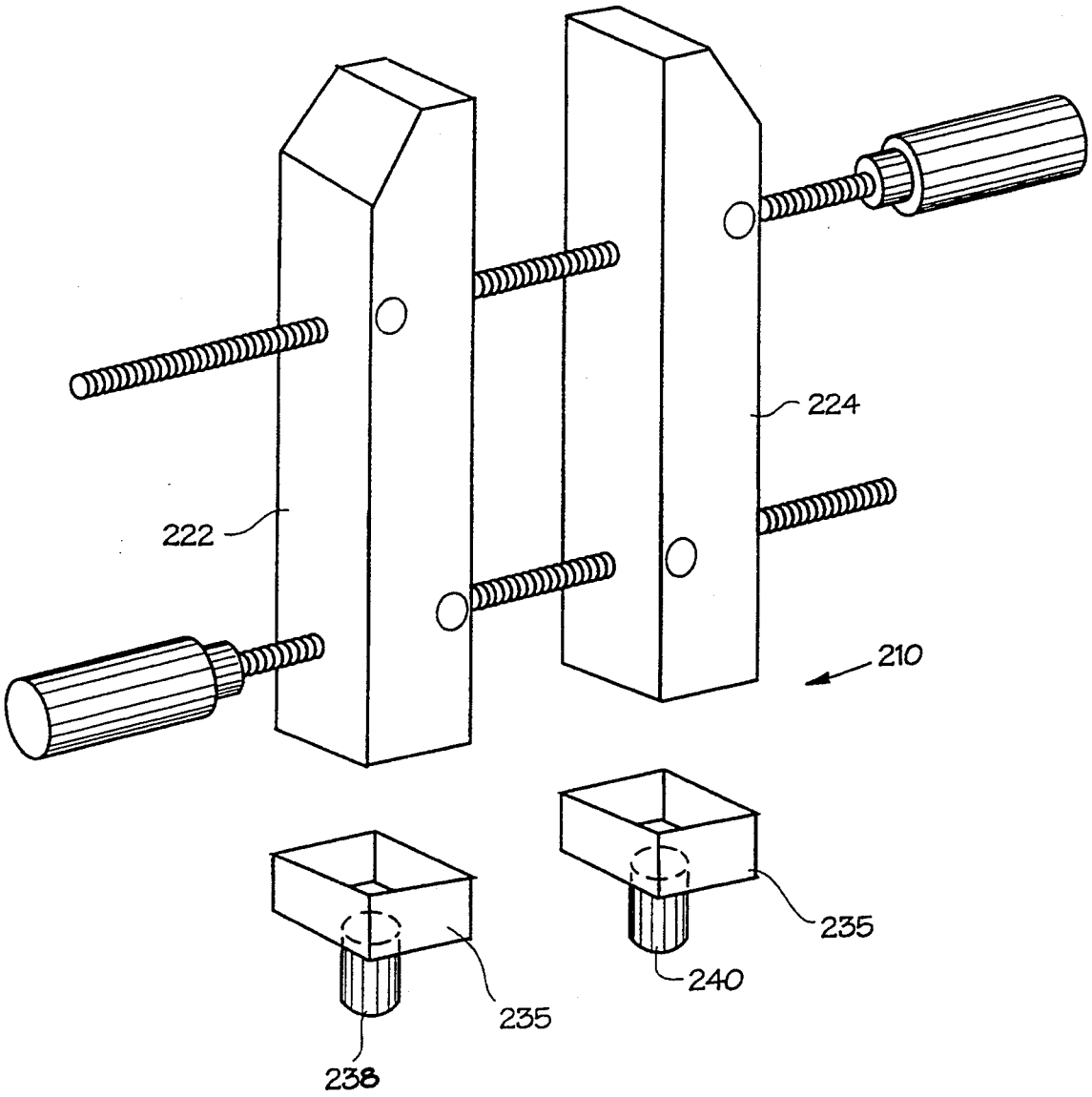
FIG. 3 is a perspective view of another preferred embodiment of the clamping apparatus of the present invention utilizing adapter brackets fitted onto an otherwise conventional form of clamping apparatus.

Those persons skilled in the art will recognize and understand that the basic structure and operation of the present apparatus and method have broad utility and numerous variations thereof are possible. The alternative embodiments of FIGS. 2 and 3 are disclosed herein by way of example but without limitation. Depending upon the specific structural members being clamped, and particularly their dimension, material, shape and the expected clamping force required, it may be desirable to form relatively larger or smaller recesses in the structural members in certain clamping operations than in other clamping applications. FIG. 2 illustrates a clamping apparatus 110 in accordance with the present invention which is equipped with threadedly insertable and removable engagement portions 138, 140 so that the clamping members 122, 124 may be selectively fitted with engagement portions of varying sizes (e.g., a set of three different engagement portions 138, 140 is illustrated) to accommodate a variety of differing clamping applications.

Also, since numerous woodworking, machinist's and like clamps of the basic construction of the present clamping apparatus 10, but without the engagement portions. 38, 40, are already in widespread use, it is also contemplated to be advantageous to provide for retrofitting existing clamps with attachable and detachable engagement portions to facilitate their use in the manner of the present invention. By way of example, FIG. 3 illustrates a conventional woodworking clamp 210 whose clamping members 222, 224 are fitted at their respective ends with attachable brackets 235 carrying outwardly-projecting engagement portions 238, 240.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. An apparatus for clamping a pair of structural members during joinder thereof in abutting relation along a joint line between respective edges of the structural members, wherein the structural members are formed with respective symmetrical recesses located on a common line substantially normal to said joint line, the clamping apparatus comprising:

first and second clamping members each having a generally elongate body portion terminating in a clamping end portion having an end surface and an adjacent side wall surface, each body portion having a pair of threaded openings formed therein, at a spacing therealong;

a selectively actuable clamping arrangement connected to each clamping member for moving them toward and away from one another for clamping objects therebetween, the clamping arrangement including a pair of threaded drive rods threadedly engaged with the openings formed in each clamping member and extending therebetween, for connecting the clamping members in adjacent side-by-side facing relation and actuating translatory movement of the clamping members in response to rotation of said threaded rods; and respective first and second removable brackets for selective attachment to and detachment from the clamping members for clamping movement integrally with the clamping members when attached thereto, each bracket having a base portion and a wall portion extending in one direction from the base portion, the base and wall portions being configured in conformity to the end and side wall surfaces of the clamping members for mating engagement of each bracket with the clamping end portion of a respective one of the clamping members, and each bracket further having an engagement pin projecting outwardly from the base portion in a generally opposite direction from the one direction, each engagement pin being configured for mating engagement with a respective one of the recesses in the structural members to fit securely therein for drawing the respective edges of the structural members into abutting relation when the brackets are attached to the clamping members and the engagement pins are received in the recesses, whereby the clamping apparatus may be selectively used for clamping operations both with and without the brackets attached to the clamping members.

2. A clamping apparatus according to claim 1 wherein each engagement pin is of the configuration of an elongate solid geometric body having a constant cross-section of a regular plane geometric shape concentric about a common longitudinal axis.

3. A clamping apparatus according to claim 2 wherein each engagement portion is cylindrical in configuration.

4. A clamping apparatus according to claim 1 wherein each engagement pin is selectively removable from the respective clamping member.

5. A clamping apparatus according to claim 4 and further comprising a set of interchangeable engagement pin for each clamping member for selective attachment thereto of any selected one of the engagement pin.

6. An apparatus for clamping a pair of structural members according to claim 1 wherein each engagement pin is of the configuration of an elongate solid geometric body having a constant cross-section of a regular plane geometric shape concentric about a common longitudinal axis.

7. An apparatus for clamping a pair of structural members according to claim 6 wherein each engagement pin is cylindrical in configuration.

8. An apparatus for clamping a pair of structural members according to claim 7 wherein each of the clamping members is elongate and generally linear in configuration, and each engagement portion extends from the respective clamping member in substantial alignment to its elongate linear extent.

* * * * *

UNITED STATES PATENT AND TRADEMARK OFFICE

CERTIFICATE OF CORRECTION

PATENT NO. : 5,335,898

DATED : August 9, 1994

INVENTOR(S) : Charles E. Johnson

It is certified that error appears in the above-identified patent and that said Letters Patent is hereby corrected as shown below:

On the Title Page and column 1, line 3, after "JOINDER", insert --THEREOF--.

Column 5, line 27, after "portions" delete "." .

Column 6, line 51, delete "pin" and insert therefor -- pins --.

Column 6, line 52, delete "pin" and insert therefor -- pins --.

Signed and Sealed this

Seventeenth Day of January, 1995

*Attest:*

Bruce Lehman

BRUCE LEHMAN

*Attesting Officer*

*Commissioner of Patents and Trademarks*